US006627805B1

(12) United States Patent
Charbonneaux et al.

(10) Patent No.: US 6,627,805 B1
(45) Date of Patent: Sep. 30, 2003

(54) AUDIO DEVICE AND METHOD INCLUDING A MEMBRANE HAVING AT LEAST TWO TONGUES WITH DIFFERENT RESONANT FREQUENCIES

(75) Inventors: Marc Charbonneaux, Lyons (FR); Patrice Morchain, L'Isle d'Abeau (FR); Pierre Piccaluga, L'Isle d'Abeau (FR); Claude-Annie Perrichon, L'Isle d'Abeau (FR)

(73) Assignee: Pica-Sound International (FR)

( * ) Notice: Subject to any disclaimer, the term of this patent is extended or adjusted under 35 U.S.C. 154(b) by 0 days.

(21) Appl. No.: 09/784,438

(22) PCT Filed: Jul. 22, 1999

(86) PCT No.: PCT/FR99/01809

§ 371 (c)(1),
(2), (4) Date: Apr. 23, 2001

(87) PCT Pub. No.: WO00/11909

PCT Pub. Date: Mar. 2, 2000

(30) Foreign Application Priority Data

Aug. 24, 1998 (FR) ..... 98 10741

(51) Int. Cl.[7] ..... G10D 13/08
(52) U.S. Cl. ..... 84/408; 381/118; 181/163
(58) Field of Search ..... 84/402–410; 181/163; 381/332–336, 118, 337–354, 160–162

(56) References Cited

U.S. PATENT DOCUMENTS 2,845,135 A 7/1958 Cohen et al.
4,997,058 A 3/1991 Bertagni
5,198,602 A * 3/1993 Roper ..... 84/408 X
5,283,397 A 2/1994 Pavlovic
5,524,062 A * 6/1996 Oh ..... 381/338

FOREIGN PATENT DOCUMENTS

| | | |
|---|---|---|
| EP | 0 627 868 | 12/1994 |
| EP | 2 77 149 | 10/1999 |
| EP | 2 777 148 | 10/1999 |

* cited by examiner

*Primary Examiner*—Jeffrey Donels
(74) *Attorney, Agent, or Firm*—Rothwell, Figg, Ernst & Manbeck

(57) ABSTRACT

For musical instruments or sound reproduction, finer sound definition is preferable. In sound reproduction, electro-acoustic transducers fitted with round membranes or electrostatic system stripes are common. No system states that the sound created is correct for the human ear. The present method concerns a fractal shape responding to criteria of the human ear shape. A membrane which, like the ear via its shape, is a set of resonators with different frequencies. The membrane shape, known as a harmony amplifier, has independent tongues emitting from a given surface, like fingers of a hand coming out of the palm. A membrane can be put into digital form by tongues. The membrane is placed in a musical instrument. Another variant is a membrane mounted on a sound frequency generator constituting an electro-acoustic transducer. This is effective for all types of musical instruments and particularly for audio and audio-visual applications.

18 Claims, 1 Drawing Sheet

AUDIO DEVICE AND METHOD INCLUDING A MEMBRANE HAVING AT LEAST TWO TONGUES WITH DIFFERENT RESONANT FREQUENCIES

TITLE OF THE INVENTION

BACKGROUND OF THE INVENTION

In the field of sound creation or the reproduction of sounds by the use of an electro-acoustic mechanism or musical instruments, it is useful that the sound definition is more intelligible. Instrumtentalists have used sound objects, such as pianos or violins, double-basses and wind instruments became well-known concerning acoustic quality criteria whose quality of the harmonics determine the tone quality at the same time.

SUMMARY OF THE INVENTION

Human hearing is characterised by the simultaneous perception of all the harmonics and transients, this criteria corresponding to the shape of the ear by which the sounds are read. The shape of the ear is the mechanical aspect of hearing and the detector and sensor of information. The method concerns a fractal form which responds to the sound resonances of different frequencies physically recorded by the shape of the human ear. Natural science has observed the various shapes of ears linked to the various listening spectrums in the hearing of animals for different evaluations of the surrounding world.

In the field of sound reproduction, it is common to make use of electro-acoustic transducers fitted with round or conical membranes. It is also common to use a strip transducer for electrostatic systems. Acoustic efficiency is the first parameter able to be quantified, but no system is able to state that the sound created is properly ordered concerning time and quality. Musicians say that transients are not retransmitted. In fact, the current techniques lack precision. The sound emitted can be organized, coded and formatted so as to be more structured at each moment and be more complete and representative of sound reality capable of being picked up by the ear. The present method consists of creating a membrane shape with a constant or variable thickness for putting harmonics into phase and precisely amplifying the harmonics. The notes are generated by tongues of different sizes and different resonances which renders auditive reading extremely complete. This membrane shape is active to emit the acoustic speed of the harmonics and transients.

Tonal balance is complete at each moment via the multitude of additional sound information. The shape of the membrane is constituted by a set of tongues resonating at different frequencies and is called a harmonics amplifier which via its shape is a set of acoustic resonators on different multiple frequencies at each moment The shape of the membrane is characterised by independent tongues and acoustic resonators emanating from a given surface, like the fingers of a hand coming out from the palm of the hand.

This membrane is fixed close to a sound generator and amplifies the harmonics by mechanical resonance.

DESCRIPTION OF THE PREFERRED EMBODIMENTS

Figure 1:
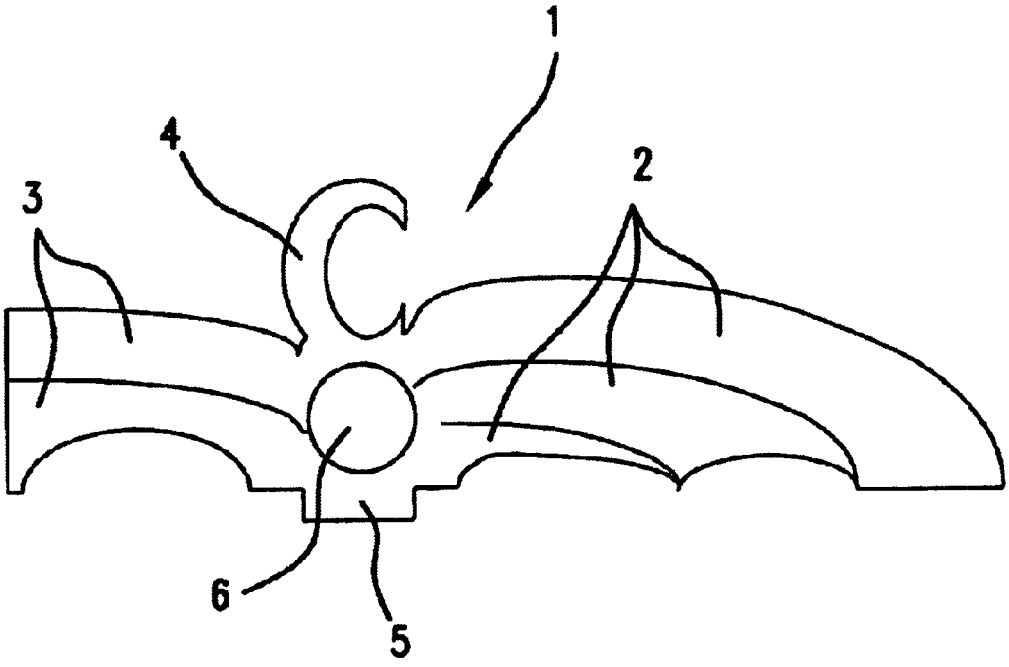
FIG. 1 shows a sound balancing device in accordance with embodiments of the present invention.

One non-restrictive example of the method concerns a sound balancing device (FIG. 1) able to differentiate the high pitches from the low ones and all intermediate notes and is constituted by a membrane with tongues, in this case a membrane put into digitized form (1) with at least two tongues and preferably three. This particular membrane is characterised by five independent tongues or digitizations, namely three large ones (2) and two small ones (3). An additional digitization (4) is an isolated rounded segment. A small digitization (5) is placed on the side of the unit. The resonators formed by the tongues or membrane can be provided with holes (6). In this non-restrictive example, this device is made of titanium with a thickness 1/10 millimeter and a length of six centimeters and is placed in a musical instrument, such as a wind instrument placed inside close to the vent, or on a violin or in a piano.

Figure 2:
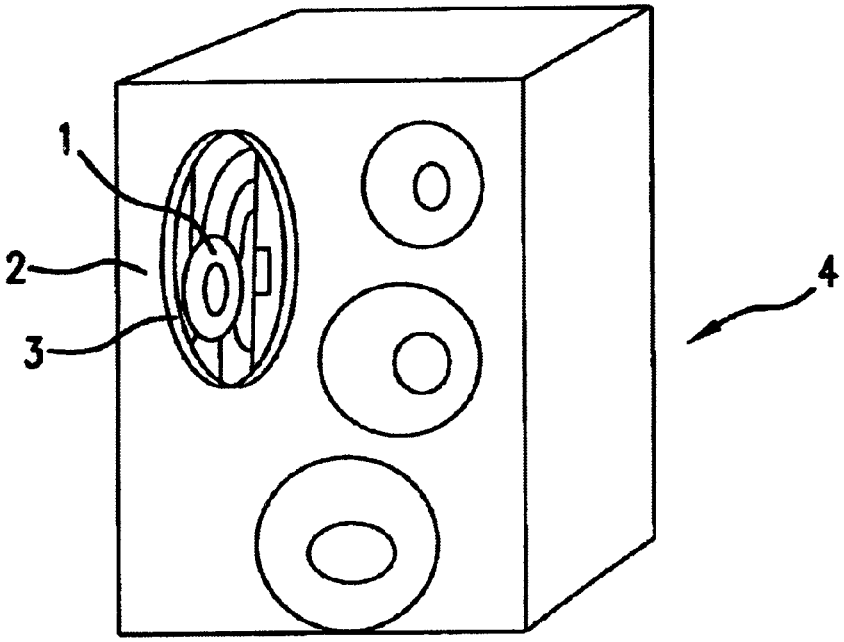
FIG. 2 shows a loudspeaker in accordance with embodiments of the present invention.

Another variant of this device (FIG. 2) with resonators on different frequencies is characterised by a digitized membrane (1) twenty centimeters long mounted on a sound frequency generator creating an electro-acoustic transducer (2) or a sound reproduction unit. The segments used as a support for the loudspeaker frame (3) thus constitute an electro-acoustic device with remarkable sound precision. The membrane is made of aluminium with a thickness of three millimeters towards the center and tapered towards the ends of the segments.

The method and device, known as a harmonic amplifier, are effective for musical instruments and audio and audio-visual applications.

What is claimed is:

1. A process for improving the perception of audio sound produced by an audio device comprising an electro-acoustic transducer, the process comprising:

providing a membrane having at least two tongues with different resonant frequencies;

exciting the membrane by means of the audio sound produced by the electro-acoustic transducer, whereby the tongues of the membrane resonate at said different resonant frequencies.

2. The process of claim 1, wherein the step of providing comprises providing a membrane with at least one hole.

3. The process of claim 1, wherein the step of providing comprises providing a membrane of a constant thickness.

4. The process of claim 1, wherein the step of providing comprises providing a membrane of a variable thickness.

5. The process of claim 1, wherein the step of providing comprises providing a membrane having a digitized form.

6. The process of claim 1, wherein the step of providing comprises providing a membrane have an isolated rounded segment.

7. An audio device comprising an electro-acoustic transducer, a membrane having at least two tongues with different resonant frequencies, said membrane being located close to the transducer, whereby the tongues of the membrane are excited by audio sound produced by the transducer and resonate at said different resonant frequencies.

8. The device of claim 7, wherein the membrane has at least one hole.

9. The device of claim 7, wherein the membrane has a constant thickness.

10. The device of claim 7, wherein the membrane has a variable thickness.

11. The device of claim 7, wherein the membrane has a digitized form.

12. The device of claim 7, wherein the membrane has an isolated rounded segment.

13. A sound frequency generator, comprising an electro-acoustic transducer, a membrane having least two tongues with different resonant frequencies, said membrane being mounted on the sound frequency generator, whereby the tongues of the membrane are excited by audio sound produced by the transducer and resonate at said different resonant frequencies.

14. The generator of claim 13, wherein the membrane has at least one hole.

15. The generator of claim 13, wherein the membrane has a constant thickness.

16. The generator of claim 13, wherein has a variable thickness.

17. The generator of claim 13, wherein the membrane has a digitized form.

18. The generator of claim 13, wherein the membrane has an isolated rounded segment.

* * * * *